US005682638A

United States Patent [19]

Kaiser

[11] Patent Number: 5,682,638

[45] Date of Patent: Nov. 4, 1997

[54] BUFFING PAD CLEANING APPARATUS

[76] Inventor: Richard A. Kaiser, N84 W28518 Center Oak Rd., Hartland, Wis. 53029

[21] Appl. No.: 563,652

[22] Filed: Nov. 28, 1995

Related U.S. Application Data

[63] Continuation-in-part of Ser. No. 345,593, Nov. 28, 1994, Pat. No. 5,471,726.

[51] Int. Cl.[6] ..... A47L 25/00

[52] U.S. Cl. ..... 15/104.92; 15/1; 15/3; 15/142

[58] Field of Search ..... 15/104.92, 1, 3, 15/142, 89; 134/6, 194

[56] References Cited

U.S. PATENT DOCUMENTS 4,786,333 11/1988 Kaiser ..... 15/104.92
4,983,221 1/1991 Kaiser ..... 15/104.92

*Primary Examiner*—Gary K. Graham
*Attorney, Agent, or Firm*—Andrus, Sceales, Starke & Sawall

[57] ABSTRACT

An apparatus for cleaning a buffing pad mounted on a rotary powered buffing machine is adapted to be adjustably mounted by a plurality of support legs within an open container containing a liquid cleaning solution. The buffing pad is placed in an upper enclosure that can be adjusted in size to correspond to buffing pads of varying thickness. The bottom of the enclosure includes a water wheel mounted for engagement by the buffing pad and rotatable between the enclosure and a point below the level of cleaning solution in the container, such that powered operation of the buffing machine and rotation of the pad drives the water wheel to deliver cleaning solution to the pad enclosure to clean accumulated wax, dirt and other materials from the pad. The device makes use of a series of rotatable cleaning wheels of the type used in prior devices which are also driven by the buffing pad and assist in loosening and removing accumulated materials from the buffing pad.

12 Claims, 5 Drawing Sheets

FIG. 12
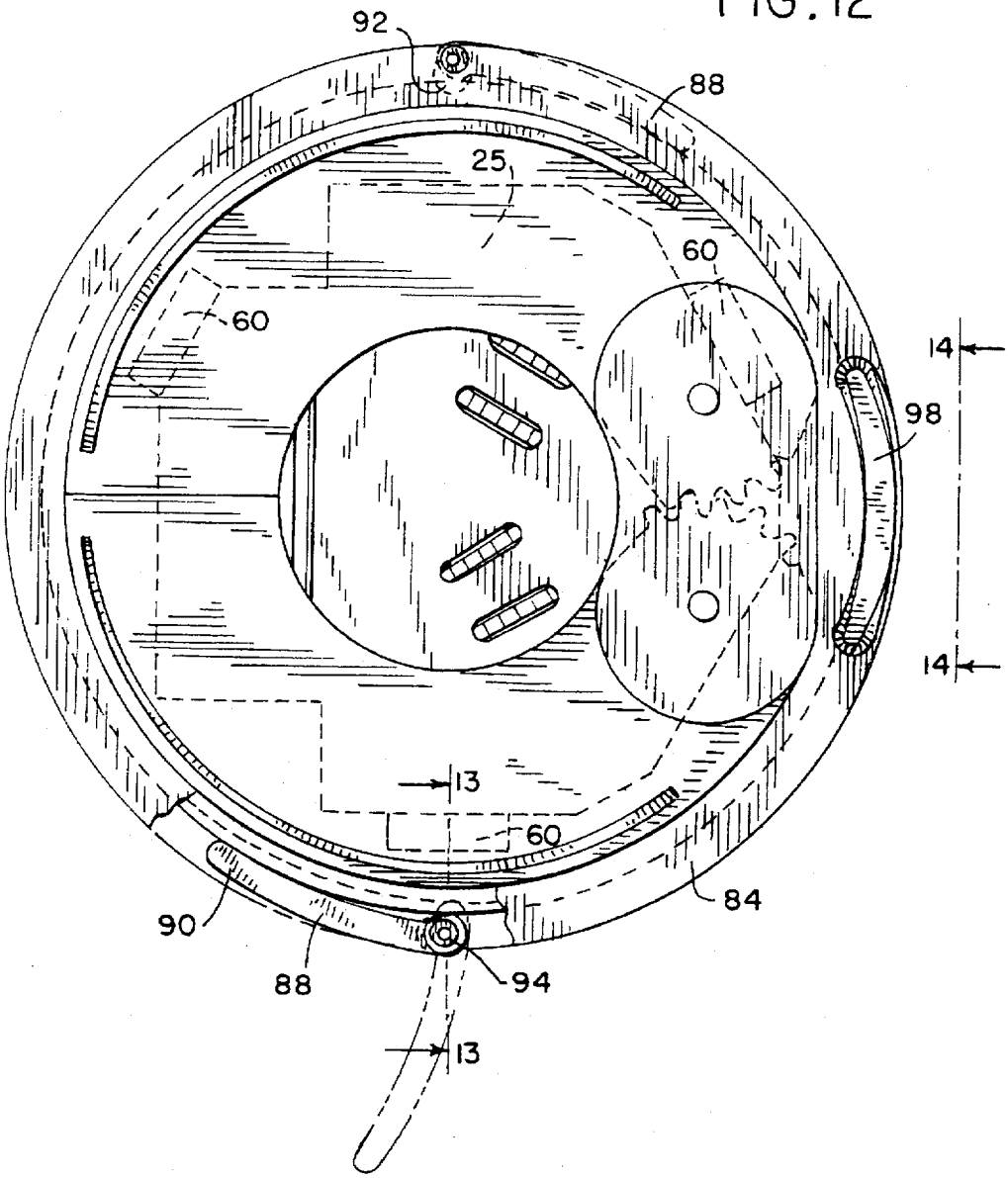
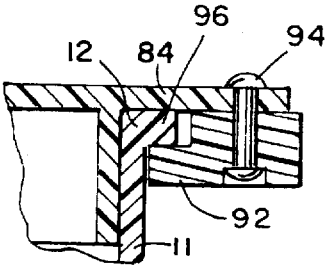
FIG. 13
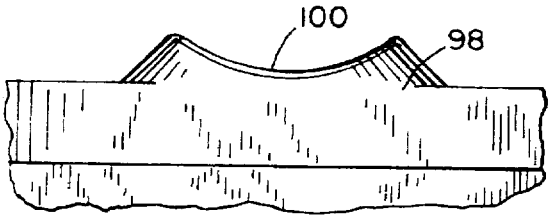
FIG. 14

BUFFING PAD CLEANING APPARATUS

RELATED APPLICATION DATA

This application is a continuation-in-part of my application Ser. No. 08/345,593, filed on Nov. 28, 1994, now U.S. Pat. No. 5,471,726.

BACKGROUND OF THE INVENTION

The present invention pertains to an apparatus for cleaning rotary buffing pads of the type mounted on and driven by a powered buffing machine. The present invention constitutes an improvement on the apparatus disclosed in my prior U.S. Pat. Nos. 4,786,333 and 4,983,221.

In the devices shown and described in my two above identified patents, an annular enclosure is sized to receive and enclose the buffing pad while it is mounted on the buffing machine with the enclosure adapted to be placed on top of a reservoir or container holding a liquid cleaning solution. The lower floor of the pad enclosure is provided with a number of rotatable cleaning wheels which are engaged and rotated by the driven buffing pad. In addition, each of these prior art devices includes a pump suspended from the underside of the enclosure floor and immersed in the cleaning solution in the container with conduit means to deliver the cleaning solution up through the floor where it is sprayed against and distributed over the face of the rotating buffing pad. In my earlier patent, the pump is driven by an electric motor powered from a separate external source. In my more recent patent, the pump is driven by a drive wheel rotatably mounted on the pad enclosure floor, driven by the rotating pad, and having a driving connection to the impeller of the pump mounted below.

The apparatus described in each of my prior patents provides a very effective means of cleaning rotary power driven buffing pads. However, in both of the described devices, the pump drive means are somewhat complex, requiring a separate electric motor in the former and a rather complex drive linkage in the latter. In addition, both prior art devices include an integral pad enclosure which because of its fixed depth, limits the thickness of buffing pad which can be accommodated and effectively cleaned.

The apparatus of the present invention is intended to improve on the foregoing deficiencies without sacrificing any aspects of the simple and effective pad cleaning provided by my prior devices.

SUMMARY OF THE INVENTION

In accordance with the principal features of the present invention, an improved apparatus for cleaning a rotary power driven buffing pad includes a water wheel which is directly driven by the buffing pad by incorporating a cleaning solution impeller in the wheel itself. The pad enclosure is adapted to be inserted into the cleaning solution container, rather than resting on the upper edge substantially outside the container. In this manner, the upper portion of the container wall forms the side wall of the pad enclosure. The floor or lower deck of the enclosure can be either demountably attached to the cover with adjustable connectors or supported within the container by a plurality of adjustable support legs, allowing the depth of the enclosure to be varied to accommodate pads of varying thicknesses.

In a preferred embodiment, the apparatus includes a reservoir for containing a liquid cleaning solution, which reservoir has an outer wall terminating in a peripheral upper edge defining an open upper end. A frame is demountably supported on the upper edge of the reservoir and the frame defines an open interior portion which is sized to receive the buffing pad while it is attached to the buffing machine. The frame includes a generally horizontal deck member which is positioned adjacent the face portion of the pad when the pad is received in the open portion of the frame. A plurality of cleaning wheels are rotatably attached to the deck and positioned to contact the face portion of the pad. A water wheel is also rotatably attached to the deck and has a peripheral edge adapted to rotate between an upper position in contact with the face of the pad and a lower position in contact with the cleaning solution in the reservoir. Rotational contact of the buffing pad with the cleaning wheels and the water wheel causes rotation thereof and delivery of cleaning solution from the reservoir to the pad.

In a preferred construction, the water wheel includes a housing which is attached to the underside of the deck member and defines a flow path between the upper and lower positions of the peripheral edge of the water wheel, and an impeller which includes the peripheral edge and is rotatably mounted on the housing to transfer the cleaning solution along the flow path. The flow path comprises an annular channel and the impeller includes a series of circumferentially spaced, radially extending vanes which are disposed to move along the flow path in response to impeller rotation.

In a preferred embodiment, the frame includes an upper rim which provides support for the frame on the upper edge of the reservoir. A cover is attached to the upper rim and is movable between an open position permitting insertion of the pad into the open interior portion of the frame and a closed position enclosing the pad in the open interior. Connector means rigidly interconnect the deck member to the upper rim. The combination of the deck member, the cover in the closed position, and the outer wall of the reservoir define the open interior portion and substantially enclose the pad therein. The connector means are preferably demountable and include means for adjusting the connections to vary the spacing between the deck portion and the upper rim and, thus, the depth of the pad enclosure.

In the most basic embodiment of the invention, the apparatus for cleaning a buffing pad mounted on a rotary powered buffing machine is adapted to be mounted on the upper edge of an open cylindrical walled container which contains a liquid cleaning solution and comprises an open sided frame which is adapted to fit within the container. The apparatus includes an upper peripheral rim which is adapted to support the apparatus on the upper edge of the container. The frame includes a deck member which depends from and is spaced below the upper rim, circumferentially spaced connector means for attaching the deck portion to the rim, and a cover which is adapted to overlie the rim. The deck member, the cover, and the adjacent portion of the container wall combine to define an open interior portion which is sized to receive and enclose the buffing pad while it is attached to the buffing machine. A water wheel is mounted to the underside of the deck member and is rotatable about a horizontal axis. The water wheel has a peripheral edge which is rotatable between an upper position wherein the edge extends through the deck member into tangent contact with the buffing pad and a lower position immersed in the cleaning solution in the container, such that powered rotation of the buffing pad causes rotation of the water wheel and delivery of cleaning solution to the pad. The water wheel preferably includes a vaned impeller which extends along the peripheral edge of the wheel and is adapted to pick up cleaning solution for delivery to the pad. As in the previously described embodiment, the connector means are preferably adjustable to selectively vary the spacing between the deck portion and the upper rim.

In another preferred embodiment, the apparatus for cleaning a buffing pad mounted on a rotary powered buffing machine includes a reservoir for containing a liquid cleaning solution, which reservoir has an outer wall terminating in a peripheral upper edge defining an open upper end. An upper rim is demountably supported on the upper edge of the reservoir and defines an opening sized to receive the buffing pad while it is attached to the buffing machine. The apparatus includes a generally horizontal deck member which is spaced below and supported within the reservoir to define an open interior portion. The horizontal deck is positioned adjacent to the face portion of the pad when the pad is positioned within the opening of the upper rim. The deck member is supported within the reservoir by a plurality of adjustable support legs which can be adjusted to vary the spacing between the deck member and the upper rim to vary the size of the open interior portion.

In a preferred embodiment, a cover is attached to the upper rim and is movable between an open position permitting the insertion of the pad into the open interior portion and a closed position enclosing the pad within the open interior portion. The upper rim of the apparatus includes a peripheral overhang which provides support for the upper rim on the upper edge of the reservoir. A plurality of attachment latches are fixed to the overhang and provide points of attachment between the upper rim and the outside of the reservoir wall. The combination of the deck member, the cover and enclosed position, and the outer wall of the reservoir define an open interior portion and substantially enclose the pad therein.

In a preferred construction, the frame of the apparatus includes an upper rim which contains a peripheral overhang to provide support for the upper rim on the upper edge of the reservoir. A generally horizontal deck member is spaced below and supported within the reservoir and positioned adjacent a face portion of the pad when the pad is positioned within the opening. The deck member is spaced below the upper rim and defines an open interior portion. A cover is attached to the upper rim and is movable between an open position which permits the insertion of the pad into the open interior portion and a closed position which encloses the pad in the open interior portion. The combination of the deck member, the cover in the closed position, and the outer wall of the reservoir define an open interior portion and substantially enclose the pad therein. The deck member is preferably supported within the reservoir by a plurality of adjustable support legs which include means for adjusting the legs to vary the spacing between the deck portion and the upper rim and, thus, the depth of the pad enclosure. A plurality of attachment latches are fixed to the overhang and provide points of attachment between the upper rim and the outer wall of the reservoir.

BRIEF DESCRIPTION OF THE DRAWINGS

FIG. 12 is a top plan view of the apparatus of an alternate embodiment of the present invention.

FIG. 13 is an enlarged horizontal section taken on line 13—13 of FIG. 12.

FIG. 14 is a horizontal section taken on line 14—14 of FIG. 12.

DETAILED DESCRIPTION OF THE PREFERRED EMBODIMENT

Figure 1:
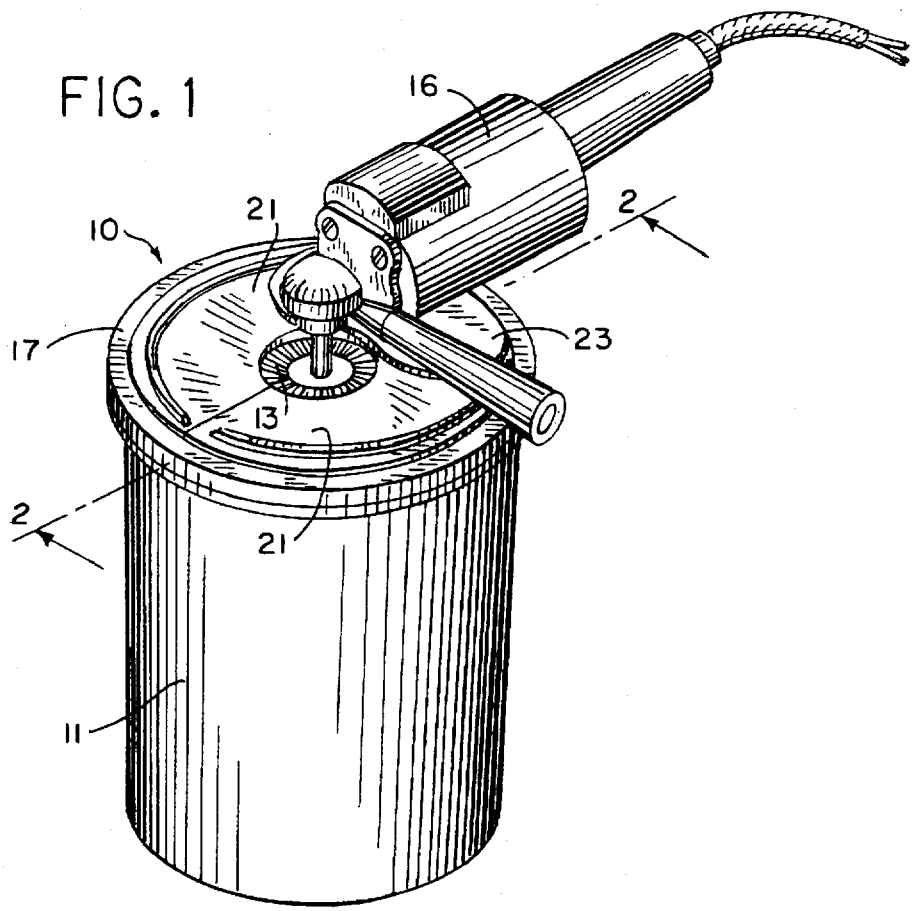
FIG. 1 is a perspective view of the cleaning apparatus of the subject invention positioned atop a container and enclosing a machine mounted buffing pad.
Figure 2:
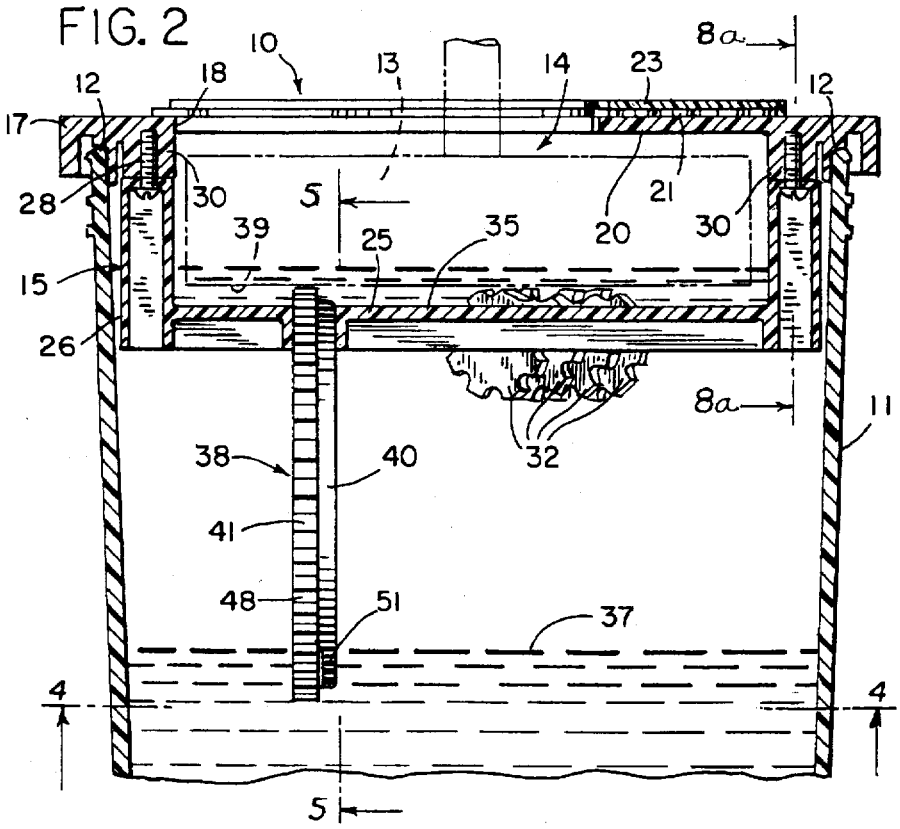
FIG. 2 is a partial vertical section taken on line 2—2 of FIG. 1.

As best seen in FIG. 1, the buffing pad cleaning apparatus 10 of the subject invention is adapted to be mounted within and rest atop a container holding a liquid cleaning solution. The container 11 may conveniently comprise a conventional 5 gallon (about 19 liter) plastic pail. Referring also to FIG. 2, the apparatus 10 is adapted to be inserted into the open upper end of the cylindrical container 11 and to rest upon the upper edge 12 thereof. The upper portion of the apparatus 10 includes a frame 15 which defines an open interior portion 14 that is sized to receive a conventional buffing pad 13 mounted on the driven shaft of a conventional buffing machine 16. As will be described in greater detail, the rotating buffing pad 13 driven by the buffing machine 16 provides the motive force for operating the cleaning apparatus, in a manner similar to my prior devices described above, but with significant improvements.

Figure 3:
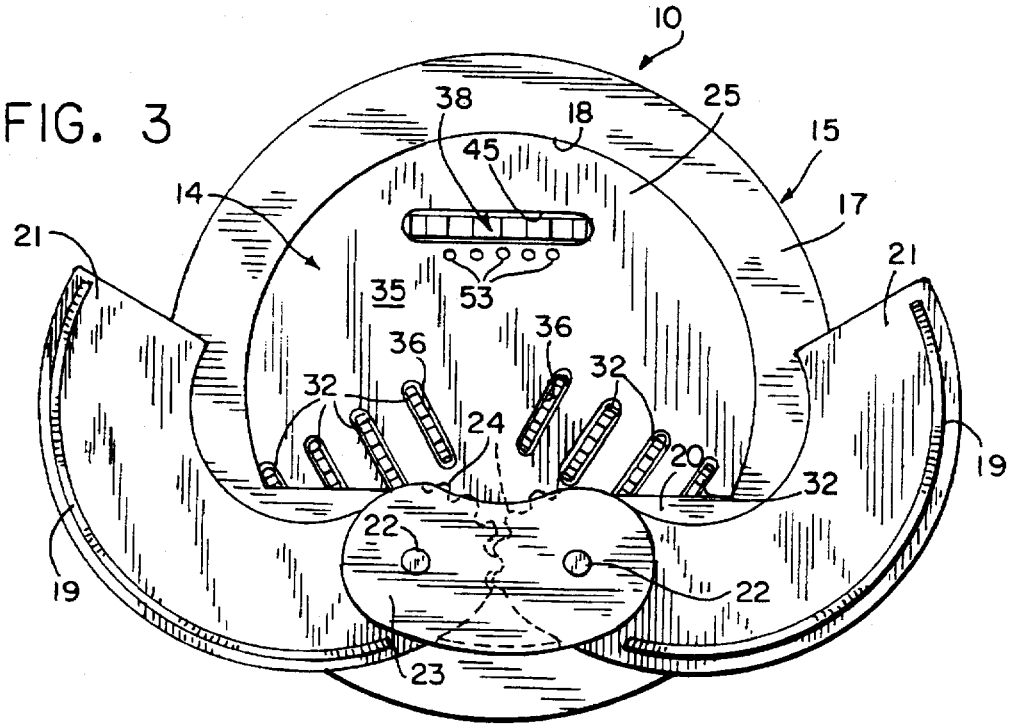
FIG. 3 is a top plan view of the apparatus of the present invention.
Figure 4:
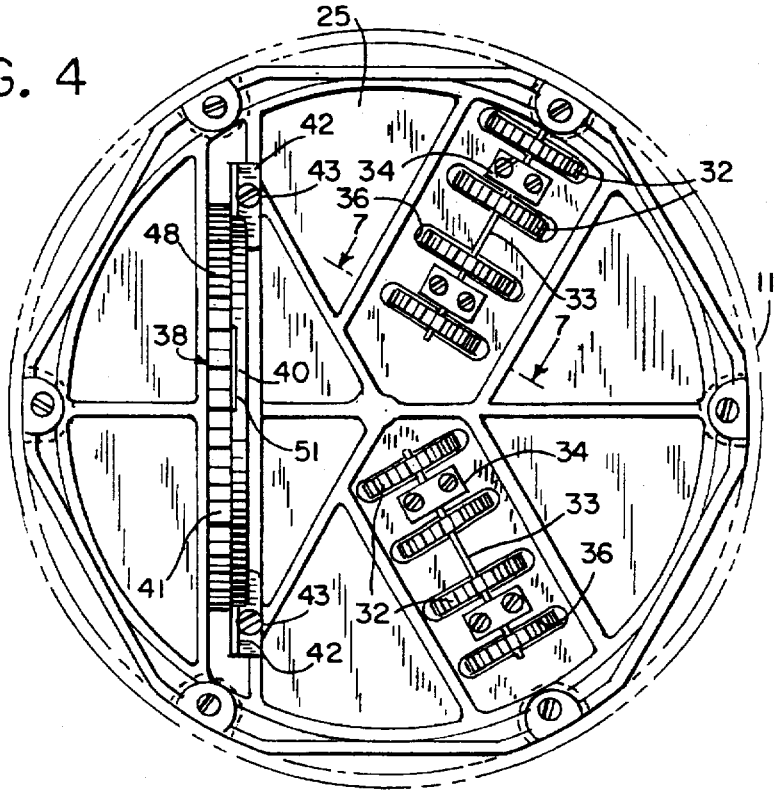
FIG. 4 is a horizontal section taken on line 4—4 of FIG. 2.
Figure 5:
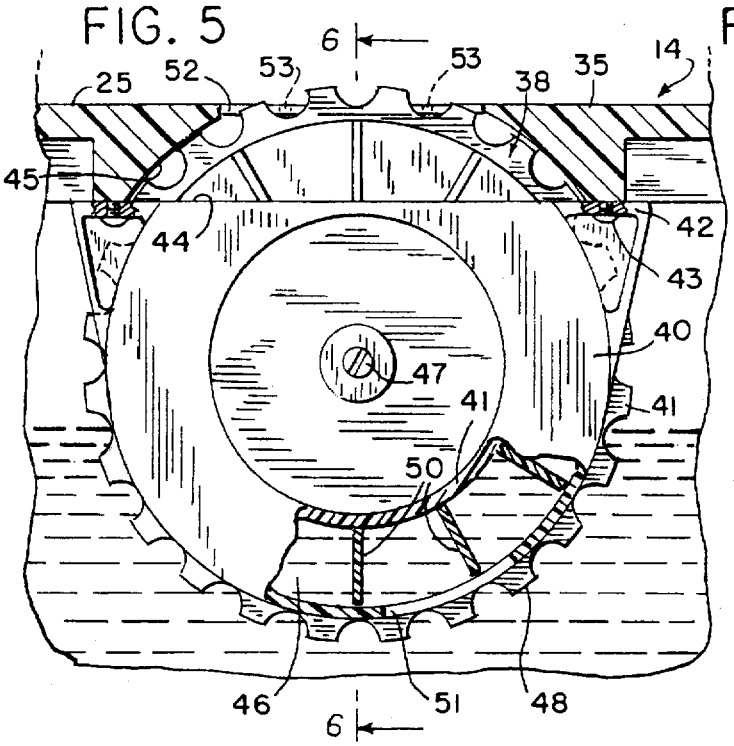
FIG. 5 is a vertical section taken on line 5—5 of FIG. 2.

Referring also to FIGS. 3–5, the frame 15 includes an annular rim 17 which is adapted to sit upon the upper edge 12 of the container 11 to provide support for the cleaning apparatus suspended therein. The rim 17 defines a large truncated circular opening 18 large enough to readily receive a conventional buffing pad 13 mounted on a buffing machine, which pad may be of a variety of sizes commonly used. The widened portion 20 of the rim 17, defining the truncated portion of the opening 18, has pivotally mounted thereon the ends of a pair of semicircular cover members 21. Each of the cover members 21 is attached by a pivot pin 22 with the ends of the cover members captured between the surface of the rim and an upper retainer 23. The abutting ends of the cover members 21 are provided with interengaging teeth 24 such that rotation of one cover member 21 about its pivot pin 22 will cause rotation of the other cover member. The upper surfaces of the cover members 21 are provided at their outer edges with integral semicircular ribs 19. The ribs provide stiffening and also means to grasp one of the cover members for opening and closing movement. With the cover members 21 in their open positions shown in FIG. 3, the buffing pad 13 is inserted through the opening 18 and into the open interior 14 and the cover members then pivoted to the closed position shown in FIG. 1.

Figure 8A:
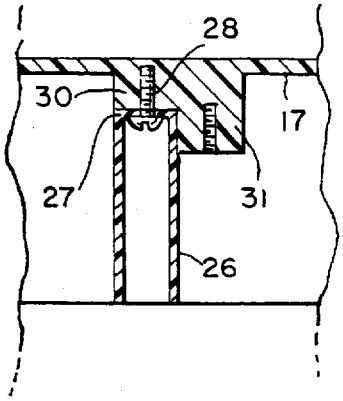
FIG. 8*a* is an enlarged vertical section taken on line 8*a*—8*a* of FIG. 2.
Figure 8B:
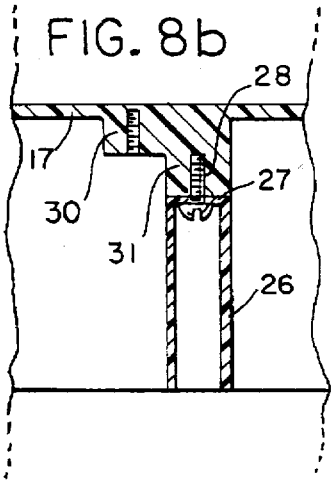
FIG. 8*b* is a vertical section similar to FIG. 8*a* showing a repositioning of certain connections.

The frame 15 includes a lower deck member 25 which lies spaced below and generally parallel to the rim 17 and cover members 21. The deck member 25 includes a number of circumferentially spaced mounting posts 26 around its outer edge by which the deck member is demountably attached to the annular rim 17. Preferably and as best seen in FIG. 2, the posts 26 are hollow and downwardly opening, but include a blind or closed upper end 27. The upper end 27 is provided with a suitable mounting hole for receipt of a mounting bolt 28 which is threaded into a mounting boss 30 depending downwardly from the underside of the rim 17. In accordance with one of the improved features of the present invention and referring also to FIGS. 8*a* and 8*b*, the rim 17 is provided with an integral auxiliary mounting boss 31 immediately adjacent each mounting boss 30. The auxiliary mounting boss 31 is of extended length such that the use thereof for attaching the deck member 25 to the rim extends the vertical space therebetween to accommodate buffing pads of greater thickness.

As is also best seen in FIG. 2, attachment of the deck member 25 via its integral mounting posts 26 (of which there are six in the disclosed embodiment) to the upper rim and cover assembly, results in a frame 15 which is open laterally around its entire periphery. However, when the frame is inserted into the container 11 and supported thereon by the annular rim 17, the side wall of the container provides an outer wall for the frame to substantially enclose the open interior 14 and the buffing pad therein. Thus, the use of the container 11 to form part of the pad enclosure simplifies the construction of this apparatus and provides an improvement over my prior art devices. As shown in FIG. 4, the outer edges of the deck member adjacent each mounting post lie directly adjacent the inner wall of the container to help maintain the position of the device therein. However, the edges of the deck member between the mounting posts are flattened and spaced from the container wall to facilitate drainage of cleaning solution back into the container, as will be described in greater detail.

Figure 7:
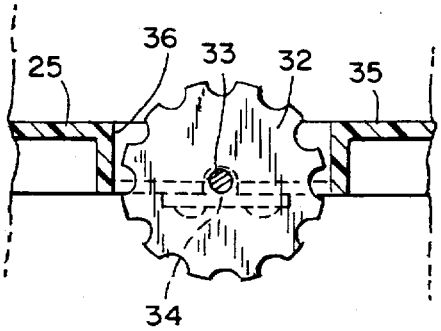
FIG. 7 is an enlarged vertical section taken on line 7—7 of FIG. 4.

The deck member 25 is provided with two rows of radially spaced cleaning wheels 32 with the wheels of each row mounted for rotation on a common axle 33 secured to the underside of the deck with a pair of mounting plates 34. The generally flat upper surface 35 of the deck member includes a plurality of open slots 36 which receive therethrough the upper peripheral edges of the cleaning wheels 32 which project above the plane of the upper surface 35, in a manner generally the same as described in my prior patents identified above. The cleaning wheels 32 are provided with a toothed configuration, as best shown in FIGS. 2 and 7, and their rotation against and under the influence of driven rotation of the buffing pad 13 helps effect a loosening of caked wax and other materials from the face of the pad. This is assisted by the spraying of cleaning solution from below as will be described. The positioning of the wheels 32 in one row is offset radially from the positioning of the wheels in the other row such that each cleaning wheel effectively tracks a different diameter circular path relative to the face of the rotating buffing pad. Thus, virtually complete contact of the buffing pad surface by the wheels is assured.

Figure 6:
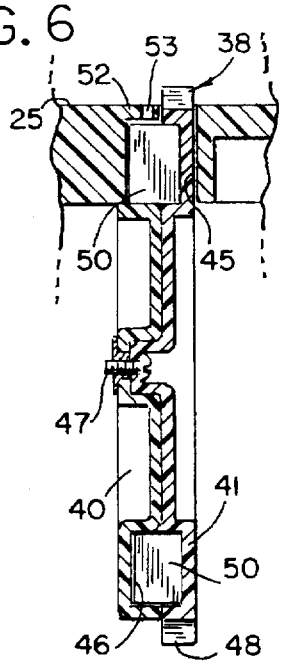
FIG. 6 is a vertical section taken on line 6—6 of FIG. 5.

A liquid cleaning solution 37 in the bottom of the container 11 is lifted upwardly through the deck and supplied to the face of the rotating buffing pad 13 by a water wheel 38 which constitutes the principal feature of the present invention. The water wheel is constructed and operates in a simple yet effective manner, making it a significant improvement over the prior art. Thus, referring also to FIG. 6, the water wheel 38 includes a housing 40 of generally circular configuration which is attached via mounting projections 42 on opposite ends of an upper face to the underside of the deck member 25, as with mounting screws 43. The flat upper edge of the housing 40 is provided with an upper opening 44 which is aligned with a large slot 45 in the deck 25. The interior face of the housing 40 is provided with an annular channel 46 which provides a flow path for the delivery of cleaning solution from the container 11 to the upper surface of the deck 25. The impeller 41 is rotatably mounted against the inside face of the housing on a pin 47. The impeller is provided with a toothed peripheral edge 48 which projects through the slot 45 in the deck member 25 to approximately the same height as the cleaning wheels 32. The inside face of the impeller 41 is provided with a series of circumferentially spaced radially extending vanes 50 which are sized and shaped to fit closely within the annular channel 46 in the housing and to move along the channel as the impeller 41 rotates on the pin 47. The vanes pass closely adjacent the underside of a thinned deck section 52 on one side of the slot 45. The deck section is provided with line of cleaning solution delivery holes 53. The lower edge of the housing 40 directly adjacent the inside face of the impeller 41 is provided with an inlet slot 51 for the cleaning solution 37. The level of cleaning solution in the container 11 need only be high enough to cover the inlet slot during the full cleaning cycle for the buffing pad.

Tangential contact between the lower face 39 of the buffing pad 13 and the upper edge of the impeller 41 causes rotation of the latter (in the same manner as previously described with respect to rotation of the cleaning wheels 32). Cleaning solution entering the annular channel 46 in the lower portion of the housing 40 is picked up by the vanes 50 of the impeller rotating therein and carried upwardly through the upper opening 44 in the housing and the delivery holes 53 in the deck section 52. The cleaning solution is thus carried into the open interior 14 and into direct contact with the face of the buffing pad 31 rotating therein. The cleaning solution spreads readily over the upper surface 35 of the deck member and is worked into the material of the pad by the action of the cleaning wheels 32. The cleaning solution drains back into the container 11 through the slots 36 and 45 and through the edge spaces between the deck member and the interior wall of the container.

Referring generally to FIGS. 9–14, an alternate and presently preferred embodiment of the invention is shown which includes a lower deck member 25 which is supported by a plurality of adjustable support legs 60 rather than being fixed to the upper rim 62. When referring to FIGS. 9–14, corresponding reference numerals will be used when possible in describing components previously disclosed in the specification. In addition, a discussion describing the operation of these corresponding components will be omitted as their operation has been described in detail in the preceding portion of the specification.

Figure 9:
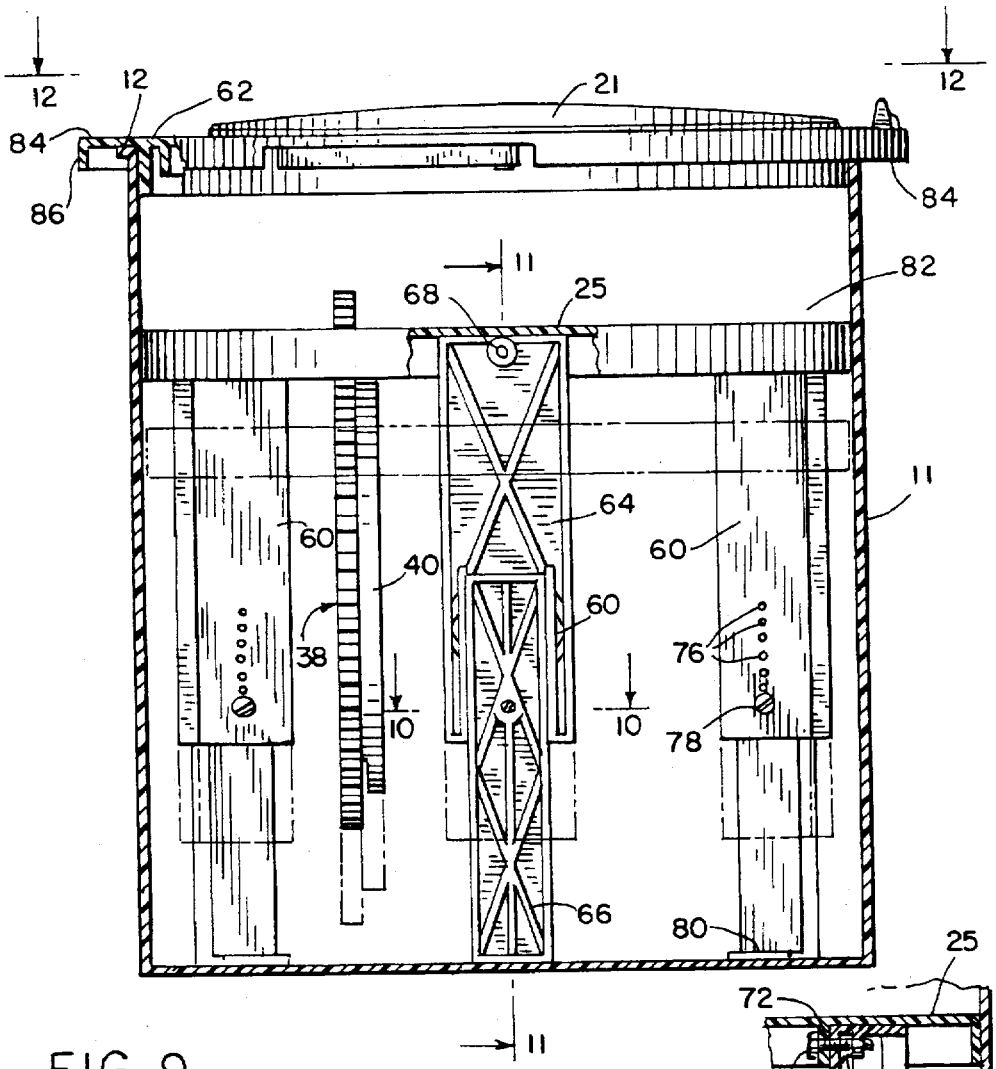
FIG. 9 is a partial vertical section of an alternate embodiment of the subject invention taken along line 2—2 of FIG. 1.

Referring now to FIG. 9, the apparatus includes a modified upper rim 62 which is adapted to be supported by the upper edge 12 of the container 11. The upper rim 62 is used to support a pair of pivotally mounted semi-circular cover members 21 which are connected and operate as previously described.

Figure 11:
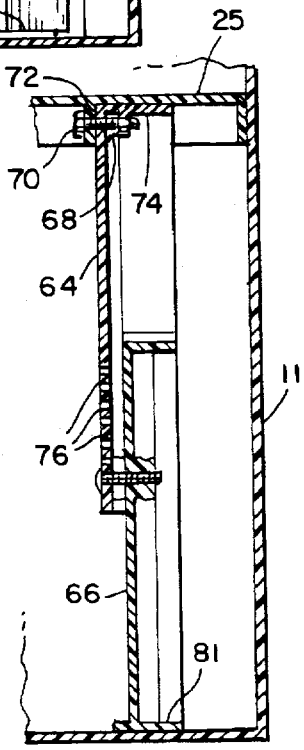
FIG. 11 is an enlarged vertical section taken on line 11—11 of FIG. 9.

As shown in FIG. 9, the horizontal deck member 25 is spaced below and generally parallel to the upper rim 62 and cover members 21. The deck member 25 is supported within the container 11, independently from the upper rim 62 and cover member 21, by a plurality of support legs 60. As shown in the preferred embodiment, the deck member is supported by three spaced support legs 60. Each of the support legs is a two-part structure having an upper portion 64 and a lower portion 66. The upper portion 64 of each support leg 60 contains a mounting aperture 68 which is used to securely attach the support leg 60 to the deck member 25. As shown in FIG. 11, a securing means 70, such as a bolt or a rivet, passes through an extended support rib 72 of the deck member 25 and the mounting aperture 68 of the upper portion 64. An upper flange 74 contacts the lower surface of the deck member 25 to increase the contact area between the support leg 60 and the deck member 25 to further stabilize the support leg 60. As can be seen in FIG. 11, the support legs 60 are slightly spaced from the outer wall of container 11.

Figure 10:
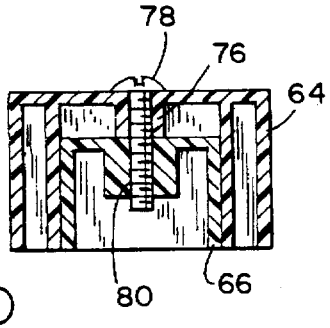
FIG. 10 is an enlarged horizontal section taken on line 10—10 of FIG. 9.

As further shown in FIGS. 9–11, the upper portion 64 of support leg 60 contains a plurality of adjustment holes 76 for providing height adjustment of deck member 25 within the container 11. As shown in FIG. 9, a screw 78 passes through the lowest of the adjustment holes 76. As can better be seen in FIGS. 10 and 11, the screw 78 passes through both the upper portion 64 and lower portion 66 of the support leg 60. In particular, the screw 78 passes through one of the adjustment holes 76 and continues into a threaded mounting hole 80 contained in the lower portion 66 of the support leg 60. The lower portion 66 further includes a flattened end portion 81 which rests on the bottom of container 11 to increase the stability of the support leg 60.

As shown in FIG. 9, an open interior portion 82 is defined by the deck member 25 at the lower portion, the outer wall of the container 11 surrounding the deck member, and the cover members 21 at the upper edge. In practice, the thickness of the open interior portion 82 corresponds to the thickness of the buffing pad to be cleaned. As shown in FIG. 9, the open interior portion 82 is at its most shallow depth since the screw 78 is in the lowest adjustment hole 76 of the support legs 60. To vary the width of the open interior portion 82, the screw 78 is removed from the lowest adjustment hole 76. With the screw removed, the upper portion 64 and the lower portion 66 of the support legs 60 are moved relative to one another. The screw 78 is then placed through a different adjustment hole 76 and into mounting hole 80, which will modify the length of the Support leg 60 and move the deck member 25 to correspond to the desired width of the open interior portion 82. Once the support legs are again securely connected by the screw 78, the deck member 25 will be supported within the container 11 at the desired distance from the cover members 21. As shown in FIG. 9 by the phantom lines, the deck member 25, the upper portion 64 of support leg 60, and the water wheel 38 all move downward upon adjustment of the screw 78.

As can be seen in FIG. 9, the upper rim 62 contains a peripheral overhang 84 that extends pass the upper edge 12 of the container 11. The peripheral overhang 84 is used to provide support for the upper rim 62 and the cover members 21. The peripheral overhang 84 further includes an overhang lip 86 that extends parallel to the outer wall of the container 11. As shown in FIG. 12, the peripheral overhang 84 includes a plurality of attachment latches 88 affixed to the lower surface of the peripheral overhang 84. Each of the attachment latches 88 is comprised of a handle 90, a cam activating surface 92, and a pivot attachment 94 as can best be seen in FIG. 13. At the position of each attachment latch 88, the peripheral overhang lip 86 is removed to allow the latch 88 to rotate about the pivot attachment 94. When the attachment latch 88 is in the closed position, the cam surface 92 presses against the container outer wall 11 to securely hold the upper rim 62 in contact with the upper edge 12. The upper edge 12 includes a horizontal extending portion 96. The cam activating surface 92 of the attachment latch 88 is moved under the horizontal extending portion 96 to prevent the upper rim 62 from being lifted away from the container 11. To remove the upper rim, the attachment latch 88 is moved to the open position shown by the phantom lines in FIG. 12. In this position, the cam activating surface 92 is no longer in contact with the outer wall of the container 11 or under the horizontal extending portion 96 of the upper edge 12 and the upper rim 62 can then be removed. In this manner, the pair of attachment latches 88 securely attach the upper rim 62, and therefore the cover members 21, to the container 11.

Referring to FIG. 12, the support legs 60 are shown in phantom as viewed from above. The three support legs 60 are positioned about the outer edges of the deck member 25 to provide stable support for the deck member 25 within the reservoir 11. In addition, the peripheral overhang 84 includes a tool rest 98 molded onto a portion of its upper surface. The tool rest 98 includes a curved surface 100 is used to support the buffing machine 16 when the buffing pad is placed within the cleaning apparatus.

Shown in FIG. 12 by phantom lines is the outline of the support ridges 72 formed on the underside of the deck member 25. As shown in FIGS. 11 and 12, the support legs 60 are each connected to the supporting ridges 72 of the deck member 25.

As in the previously described embodiment, the deck member 25 includes corresponding cleaning wheels 32 and a water wheel 38 to clean a buffing pad inserted into the open interior portion 82. In a similar manner, these components supply cleaning solution to the rotating buffing pad and remove caked wax and other materials from the face of the pad.

In my two prior patents identified above, after the pad had been thoroughly cleaned, the cleaning solution delivery pump was shut off or the cleaning solution supply passage was manually closed off so that the buffing pad could be spun in the absence of cleaning solution to discharge cleaning solution therefrom by centrifugal force. The apparatus of the present invention has been simplified insofar as I have discovered that a separate shut off of cleaning solution supply is not necessary. By providing an open interior 14 within the frame 15 of sufficient vertical depth, the operator may simply raise the buffing machine and attached pad up slightly and out of contact with the water wheel 38 (which will also take the pad out of contact with the cleaning wheels 32). Of course, when rotation of the impeller 41 of the cleaning wheel stops, delivery of cleaning solution is also stopped and continued spinning of the pad will discharge water accumulated therein by centrifugal force.

I claim:

1. An apparatus for cleaning a rotary power driven buffing pad having a buffing face portion while the pad is mounted on a buffing machine, said apparatus comprising:

a reservoir for containing a liquid cleaning solution, said reservoir including an outer wall having a peripheral upper edge defining an open upper end;

an upper rim demountably supported on said reservoir upper edge, said upper rim defining an opening sized to receive the buffing pad while attached to the buffing machine;

a generally horizontal deck member supported within the reservoir by support means other than said rim and positioned adjacent the face portion of the pad when the pad is positioned within the opening;

a plurality of cleaning wheels rotatably attached to the deck member and positioned to contact said pad face portion;

a water wheel rotatably attached to the deck and having a peripheral edge rotatable between an upper position in contact with said pad face portion and a lower position in contact with the cleaning solution in the reservoir;

whereby rotational contact of the buffing pad with the cleaning wheels and the water wheel causes rotation thereof and the delivery of cleaning solution to said pad.

2. The apparatus as set forth in claim 1 wherein said support means is comprised of a plurality of adjustable support legs.

3. An apparatus for cleaning a rotary power driven buffing pad having a buffing face portion while the pad is mounted on a buffing machine, said apparatus comprising:

a reservoir for containing a liquid cleaning solution, said reservoir including an outer wall having a peripheral upper edge defining an open upper end;

an upper rim demountably supported on said reservoir upper edge, said upper rim defining an opening sized to receive the buffing pad while attached to the buffing machine;

a generally horizontal deck member supported within the reservoir by a plurality of support legs and positioned adjacent the face portion of the pad when the pad is positioned within the opening, said deck member spaced below said upper rim to define an open interior portion;

a plurality of cleaning wheels rotatably attached to the deck member and positioned to contact said pad face portion;

a water wheel rotatably attached to the deck and having a peripheral edge rotatable between an upper position in contact with said pad face portion and a lower position in contact with the cleaning solution in the reservoir;

whereby rotational contact of the buffing pad with the cleaning wheels and the water wheel causes rotation thereof and the delivery of cleaning solution to said pad.

4. The apparatus as set forth in claim 3 wherein said deck member support legs are adjustable to vary the spacing between said deck member and said upper rim to vary the size of said open interior portion.

5. The apparatus as set forth in claim 3 wherein said water wheel comprises:

a housing attached to the underside of the deck member and defining a flow path between the upper and lower portions of the water wheel peripheral edge; and, an impeller including said peripheral edge rotatably mounted on the housing to transfer cleaning solution along said flow path.

6. The apparatus as set forth in claim 5 wherein said flow path comprises an annular channel and said impeller includes a series of circumferentially spaced radially extending vanes disposed to move along the flow path in response to impeller rotation.

7. The apparatus as set forth in claim 3 wherein said upper rim comprises:

a peripheral overhang providing support for said upper rim on the upper edge of said reservoir;

a cover attached to said upper rim and movable between an open position permitting insertion of the pad into said open interior portion and a closed position enclosing said pad in said open interior portion; and, attachment means fixed to said overhang for providing attachment between said upper rim and said reservoir outer wall.

8. The apparatus as set forth in claim 7 wherein said deck member, said cover in the closed position and the outer wall of said reservoir define the open interior portion and substantially enclose the pad therein.

9. The apparatus as set forth in claim 7 wherein said attachment means are a plurality of attachment latches having a handle and an activating surface.

10. An apparatus adapted to be mounted on the upper edge of and supported within an open cylindrical walled container containing a liquid cleaning solution for cleaning a buffing pad mounted on a rotary powered buffing machine, said apparatus comprising:

an upper rim having a peripheral overhang adapted to support said upper rim on the upper edge of the container and a cover adapted to overlie said rim;

a generally horizontal deck member spaced below said upper rim and supported within the container by a plurality of support legs;

said deck member, said cover, and the adjacent portion of the container wall defining an open interior portion sized to receive and enclose the buffing pad while attached to the buffing machine; and, a water wheel mounted to the underside of the deck member for rotation about a horizontal axis, said wheel having a peripheral edge rotatable between an upper position wherein the edge extends through said deck member into tangent contact with the buffing pad and a lower position immersed in the cleaning solution in the container;

whereby powered rotation of the buffing pad causes rotation of the water wheel and the delivery of cleaning solution to the pad.

11. The apparatus as set forth in claim 10 including a vaned impeller extending along the peripheral edge of said water wheel and adapted to pick up cleaning solution for said delivery.

12. The apparatus as set forth in claim 10 wherein said support legs are adjustable to selectively vary the spacing between said deck member and said upper rim.

* * * * *